US011674301B2

(12) United States Patent
Cooper et al.

(10) Patent No.: US 11,674,301 B2
(45) Date of Patent: Jun. 13, 2023

(54) DOUBLE-CABIN FEATURING AN ANGULAR WALL

(71) Applicant: Virgin Cruises Intermediate Limited, Plantation, FL (US)

(72) Inventors: Deirdre Cooper, Hove (GB); Jaime Douglas, Fort Lauderdale, FL (US); Luke Pearson, London (GB); Tom Lloyd, London (GB); Joscha Brose, Berlin (DE)

( * ) Notice: Subject to any disclaimer, the term of this patent is extended or adjusted under 35 U.S.C. 154(b) by 0 days.

(21) Appl. No.: 15/799,693

(22) Filed: Oct. 31, 2017

(65) Prior Publication Data

US 2020/0385977 A1 Dec. 10, 2020

(51) Int. Cl.

| | |
|---|---|
| ***E04B 1/343*** | (2006.01) |
| ***B63B 29/02*** | (2006.01) |
| ***E04B 2/82*** | (2006.01) |

(52) U.S. Cl.

CPC ..... *E04B 1/343* (2013.01); *B63B 29/025* (2013.01); *E04B 2/827* (2013.01); *E05Y 2900/142* (2013.01)

(58) Field of Classification Search

CPC .. E04H 1/02; E04H 1/00; E04H 1/005; E04B 1/34815

See application file for complete search history.

(56) References Cited

U.S. PATENT DOCUMENTS 1,464,189 A * 8/1923 Hustace ..... E04H 1/02 52/236.3
2,247,340 A * 6/1941 Webster ..... E04B 1/348 52/79.8
2,625,714 A * 1/1953 Clark ..... E04H 1/02 52/169.5

(Continued)

FOREIGN PATENT DOCUMENTS

CN 1747870 A 2/1948
CN 203393869 U 1/2014

(Continued)

OTHER PUBLICATIONS

Jim Watson, "Hotel Room Floor Plan", http://www.jamesrobertwatson.com/hotelroom.html, Nov. 3, 2016, 3 pages.

(Continued)

*Primary Examiner* — Gisele D Ford
(74) *Attorney, Agent, or Firm* — Norvell IP LLC

(57) ABSTRACT

A method of creating a pair of cabins comprising: a first cabin; a second cabin; wherein the first cabin and the second cabin are adjacent to each other and are defined by a plurality of outer walls defining a substantially rectangular area containing the first cabin and the second cabin; wherein the first outer wall meets the second outer wall at a ninety (90) degree angle, the second outer wall meets the third outer wall at a ninety (90) degree angle, the third outer wall meets the fourth outer wall at a ninety (90) degree angle, and the fourth outer wall meets the first outer wall at a (90)

(Continued)

degree angle; the first cabin and second cabin also sharing a common wall separating the first cabin from the second cabin; and wherein the common wall is operatively connected to an outer wall at an angle other than ninety (90) degrees.

20 Claims, 6 Drawing Sheets

(56) References Cited

U.S. PATENT DOCUMENTS 3,002,233 A * 10/1961 Obata ..... E04H 3/30 52/7
3,058,123 A * 10/1962 Pink ..... A47C 17/36 5/2.1
3,059,246 A * 10/1962 Shlaes ..... A47C 17/36 5/2.1
3,084,351 A * 4/1963 Kulp ..... A47C 17/36 5/2.1
3,106,724 A * 10/1963 Kamp ..... A47C 17/36 5/8
3,292,327 A * 12/1966 Van Der Lely ..... B28B 5/10 52/79.13
3,623,285 A 11/1971 Kelly
3,852,924 A * 12/1974 Levenson ..... E04H 1/02 52/79.2
3,952,465 A 4/1976 Masiello
4,000,589 A * 1/1977 Bianchini ..... E04B 1/34815 52/79.5
4,198,791 A 4/1980 Kalkaslief
4,321,717 A * 3/1982 Serra ..... A47C 17/16 5/26.1
4,325,205 A * 4/1982 Salim ..... F24S 20/61 52/79.1
4,513,545 A * 4/1985 Hopkins, Jr. ..... E04B 1/348 52/745.03
4,528,928 A 7/1985 Virta et al.
4,920,711 A * 5/1990 Mitchell, Sr. ..... E04B 1/34807 52/169.2
4,942,706 A * 7/1990 Todd ..... E04H 1/02 52/169.3
4,959,933 A 10/1990 Lappi
5,575,120 A * 11/1996 Handley ..... A47B 87/007 446/124
5,906,075 A * 5/1999 Sowers ..... E04H 1/02 52/126.1
6,016,636 A 1/2000 Caputo
6,035,585 A * 3/2000 Boyd ..... B60S 3/00 52/79.1
6,164,018 A * 12/2000 Runge ..... E04H 3/22 52/174
6,192,648 B1 2/2001 Chevalier
6,243,993 B1 6/2001 Swensson
6,256,936 B1 * 7/2001 Swensson ..... A47K 4/00 312/140.1
6,494,013 B2 * 12/2002 Winskye ..... E04B 1/24 52/220.2
6,826,879 B1 * 12/2004 Allen ..... E04B 1/34815 52/143
7,418,803 B2 9/2008 Jenkins
8,499,504 B1 * 8/2013 Sherbakov ..... E04B 1/3483 52/79.9
9,194,143 B2 11/2015 McLoughlin et al.
2005/0001097 A1 1/2005 Saint-James
2005/0252099 A1 * 11/2005 Jenkins ..... E04H 1/02 52/79.1
2005/0252100 A1 * 11/2005 Nord ..... E04H 1/02 52/79.4
2009/0031642 A1 * 2/2009 Donovan ..... F24F 5/0046 52/79.1
2010/0043339 A1 * 2/2010 Van Dijk ..... E04C 2/20 52/653.2
2014/0096461 A1 4/2014 McLoughlin et al.
2015/0052832 A1 * 2/2015 McLoughlin ..... A47C 17/86 52/173.1
2015/0089890 A1 4/2015 McLoughlin et al.
2015/0308136 A1 10/2015 Kuechenmeister et al.
2016/0010883 A1 * 1/2016 Jornitz ..... F24F 3/16 454/187
2016/0076266 A1 3/2016 McLoughlin et al.
2017/0002579 A1 * 1/2017 French ..... E04C 2/523
2017/0025988 A1 * 1/2017 Blaskovich ..... H02S 20/23

FOREIGN PATENT DOCUMENTS

CN 203693016 U 7/2014
DE 40 05 902 A1 8/1991
DE 203 18 195 U1 4/2004
EP 1816067 B1 8/2011
EP 2987717 A1 2/2016
GB 313 382 A 6/1929
GB 598 859 A 2/1948
JP S61-211458 A 9/1986
JP 2533987 Y2 4/1997
JP 3137478 11/2007
JP 2014 133519 A 7/2014
KR 10-2007-0079897 A 8/2007
WO WO2014208301 A1 12/2014

OTHER PUBLICATIONS

"Anthem of the Seas and Quantum of the Seas Cabins Review", http//anthemoftheseas.blogspot.com, Nov. 3, 2016, 10 pages.
"Avalon Waterways Suite Shlps-European River Cruises", http://www.avalonwaterways.com/River-Cruise-Ships/Suite-Ships/, Nov. 3, 2016, 4 pages.
Mary Lou Bakker, Chapter 14. Space Planning, Space Planning For Commercial Office Interiors, 2012, p. 203, 1st Ed., Fairchild Books, NY, US.

* cited by examiner

DOUBLE-CABIN FEATURING AN ANGULAR WALL

BACKGROUND

In conventional cabin configurations, a cabin is fitted with a bed, a sofa, and other furnishings such as a desk, desk chair and other such related items.

In order to minimize the space required for a cabin, while still allowing sufficient space for a user or users to circulate about the cabin, past methods for configuring the cabin utilized a method of placing a kink, or S offset, to a common wall between two adjacent cabins. The kink, or S offset, allows for the reallocation of some space along a portion of the common wall by making a cabin wider at one portion along the common wall (by taking space away from the adjacent cabin) while making the same cabin narrower along another portion of the common wall (by giving space to the adjacent cabin). The trading of space along the common wall by use of a kink, or S offset, allows larger objects, such as beds or sofas, to be positioned in a smaller cabin than would otherwise be possible without making the cabin feel cramped. However, this solution still has its limitations and can still result in a less than optimal use of space.

In view of the disadvantages associated with currently available methods and devices for a method of configuring a cabin, there is a need for a device and method that allows for improved use of space in a cabin by maximizing the number of users who can sleep in a cabin while minimizing the space required for the cabin to feel roomy enough for all occupants.

BRIEF DESCRIPTION

According to an aspect, the present embodiments may be a method of creating a pair of cabins comprising: a first cabin; a second cabin; wherein the first cabin and the second cabin are adjacent to each other and are defined by a first outer wall, a second outer wall, a third outer wall and a fourth outer wall; the first outer wall, second outer wall, third outer wall and fourth outer wall defining a substantially rectangular area containing the first cabin and the second cabin; wherein the first outer wall meets the second outer wall at a ninety (90) degree angle, the second outer wall meets the third outer wall at a ninety (90) degree angle, the third outer wall meets the fourth outer wall at a ninety (90) degree angle, and the fourth outer wall meets the first outer wall at a (90) degree angle; the first cabin and second cabin also sharing a common wall separating the first cabin from the second cabin; and wherein the common wall separating the first cabin from the second cabin is operatively connected to an outer wall at an angle other than ninety (90) degrees.

According to another aspect, the present embodiments may further comprise the method of creating a pair of cabins wherein the first cabin, or the second cabin, or both the first cabin and second cabin further comprise at least one L shaped sofa bed capable of being easily convened from a sofa to a bed and back again and dimensioned large enough to accommodate two (2) users when configured as a bed.

According to another aspect, the present embodiments may further comprise the method of creating a pair of cabins wherein the at least one L shaped sofa bed further comprises a stationary mattress on a plinth, a movable mattress on a plinth with drawers underneath, a movable armrest, and sofa back cushions capable of being easily converted from a sofa to a bed and back again.

According to another aspect, the present embodiments mas further comprise the method of creating a pair of cabins wherein the at least one L shaped sofa bed is capable of being converted into a bed for two (2) users as well as capable of being converted into additional separate bed for one (1) additional user.

According to another aspect, the present embodiments may further comprise the method of creating a pair of cabins wherein the at least one L shaped sofa bed further comprises an additional mattress on a plinth with drawers underneath capable of being converted into a bed by unfolding the additional mattress, or rotating the additional mattress or both unfolding and rotating the additional mattress.

According to another aspect, the present embodiments may further comprise the method of creating a pair of cabins wherein the at least one L shaped sofa bed is positioned along the common wall.

According to another aspect, the present embodiments may further comprise the method of creating a pair of cabins, wherein the first cabin and the second cabin each further comprise a bathroom.

According to another aspect, the present embodiments may further comprise the method of creating a pair of cabins wherein the bathroom further comprises a firewall between the bathroom and a service space.

According to another aspect, the present embodiments may further comprise the method of creating a pair of cabins wherein the first cabin, the second cabin, or both the first cabin and second cabin further comprise at least one interconnecting door on at least one outer wall.

According to another aspect, the present embodiments may further comprise the method of creating a pair of cabins wherein the first cabin, the second cabin, or both the first cabin and second cabin further comprise wherein heating, ventilation and air conditioning duct work is positioned along the common wall.

According to another aspect, the present embodiments may further comprise the method of creating a pair of cabins wherein the first cabin, the second cabin, or both the first cabin and second cabin further comprise a desk and desk chair.

According to another aspect, the present embodiments may further comprise the method of creating a pair of cabins wherein the first cabin, the second cabin, or both the first cabin and second cabin further comprise a closet.

According to another aspect, the present embodiments may be a method of creating a pair of cabins comprising: a first cabin; a second cabin; wherein the first cabin and the second cabin are adjacent to each other and are defined by a first outer wall, a second outer wall, a third outer wall and a fourth outer wall; the first outer wall, second outer wall, third outer wall and fourth outer wall defining a substantially rectangular area containing the first cabin and the second cabin; wherein the first outer wall meets the second outer wall at a ninety (90) degree angle, the second outer wall meets the third outer wall at a ninety (90) degree angle, the third outer wall meets the fourth outer wall at a ninety (90) degree angle; and the fourth outer wall meets the first outer wall at a (90) degree angle; the first cabin and second cabin also sharing a common wall separating the first cabin from the second cabin; wherein the common wall separating the first cabin from the second cabin is operatively connected to an outer wall at an angle other than ninety (90) degrees; wherein the first cabin, or the second cabin, or both the first cabin and second cabin further comprise at least one L shaped sofa bed capable of being easily converted from a sofa to a bed and back again and dimensioned large enough to accommodate two (2) users when configured as a bed; and wherein the at least one L shaped sofa bed further comprises a stationary mattress on a plinth, a movable mattress on a plinth with drawers underneath, a movable armrest, and sofa back cushions capable of being easily converted from a sofa to a bed and back again.

According to another aspect, the present embodiments may further comprise the method of creating a pair of cabins wherein the at least one L shaped sofa bed is capable of being converted into a bed for two (2) users as well as capable of being converted into additional separate bed for one (1) additional user.

According to another aspect, the present embodiments may further comprise the method of creating a pair of cabins wherein the at least one L shaped sofa bed further comprises an additional mattress on a plinth with drawers underneath capable of being converted into a bed by unfolding the additional mattress, or rotating the additional mattress or both unfolding and rotating the additional mattress.

According to another aspect, the present embodiments may further comprise the method of creating a pair of cabins wherein the at least one L shaped sofa bed is positioned along the common wall.

According to another aspect, the present embodiments may further comprise the method of creating a pair of cabins wherein the first cabin and the second cabin each further comprise a bathroom.

According to another aspect, the present embodiments may further comprise the method of creating a pair of cabins wherein the bathroom further comprises a firewall between the bathroom and a service space.

According to another aspect, the present embodiments may further comprise the method of creating a pair of cabins wherein the first cabin, the second cabin, or both the first cabin and second cabin further comprise at least one interconnecting door on at least one outer wall.

According to another aspect, the present embodiments may be a method of creating a pair of cabins comprising: a first cabin; a second cabin; wherein the first cabin and the second cabin are adjacent to each other and are defined by a first outer wall, a second outer wall, a third outer wall and a fourth outer wall; the first outer wall, second outer wall, third outer wall and fourth outer wall defining a substantially rectangular area containing the first cabin and the second cabin; wherein the first outer wall meets the second outer wall at a ninety (90) degree angle, the second outer wall meets the third outer wall at a ninety (90) degree angle, the third outer wall meets the fourth outer wall at a ninety (90) degree angle, and the fourth outer wall meets the first outer wall at a (90) degree angle; the first cabin and second cabin also sharing a common wall separating the first cabin from the second cabin; wherein the common wall separating the first cabin from the second cabin is operatively connected to an outer wall at an angle other than ninety (90) degrees; wherein the first cabin, or the second cabin, or both the first cabin and second cabin further comprise at least one L shaped sofa bed capable of being easily converted from a sofa to a bed and back again and dimensioned large enough to accommodate two (2) users when configured as a bed; and wherein the at least one L shaped sofa bed further comprises a stationary mattress on a plinth, a movable mattress on a plinth with drawers underneath, a movable armrest, and sofa back cushions capable of being easily converted from a sofa to a bed and back again; wherein the at least one L shaped sofa bed is positioned along the common wall; wherein the first cabin and the second cabin each further comprise a bathroom; wherein the bathroom further comprises a firewall between the bathroom and a service space; and wherein the first cabin, the second cabin, or both the first cabin and second cabin further comprise at least one interconnecting door on at least one outer wall.

BRIEF DESCRIPTION OF THE FIGURES

A more particular description will be rendered by reference to specific embodiments thereof that are illustrated in the appended drawings. Understanding that these drawings depict only typical embodiments thereof and are not therefore to be considered to be limiting of its scope, exemplary embodiments will be described and explained with additional specificity and detail through the use of the accompanying drawings in which:

FIG. 3 is an end view of the embodiment according to FIG. 1;

Various features, aspects, and advantages of the embodiments will become more apparent from the following detailed description, along with the accompanying figures in which like numerals represent like components throughout the figures and text. The various described features are not necessarily drawn to scale, but are drawn to emphasize specific features relevant to some embodiments.

DETAILED DESCRIPTION

Reference will now be made in detail to various embodiments. Each example is provided by way of explanation, and is not meant as a limitation and does not constitute a definition of all possible embodiments.

For purposes of illustrating features of the embodiments, a simple example will now be introduced and referenced throughout the disclosure. Those skilled in the art will recognize that this example is illustrative and not limiting and is provided purely for explanatory purposes. In the illustrative example and as seen in FIG. 1.

Figure 1:
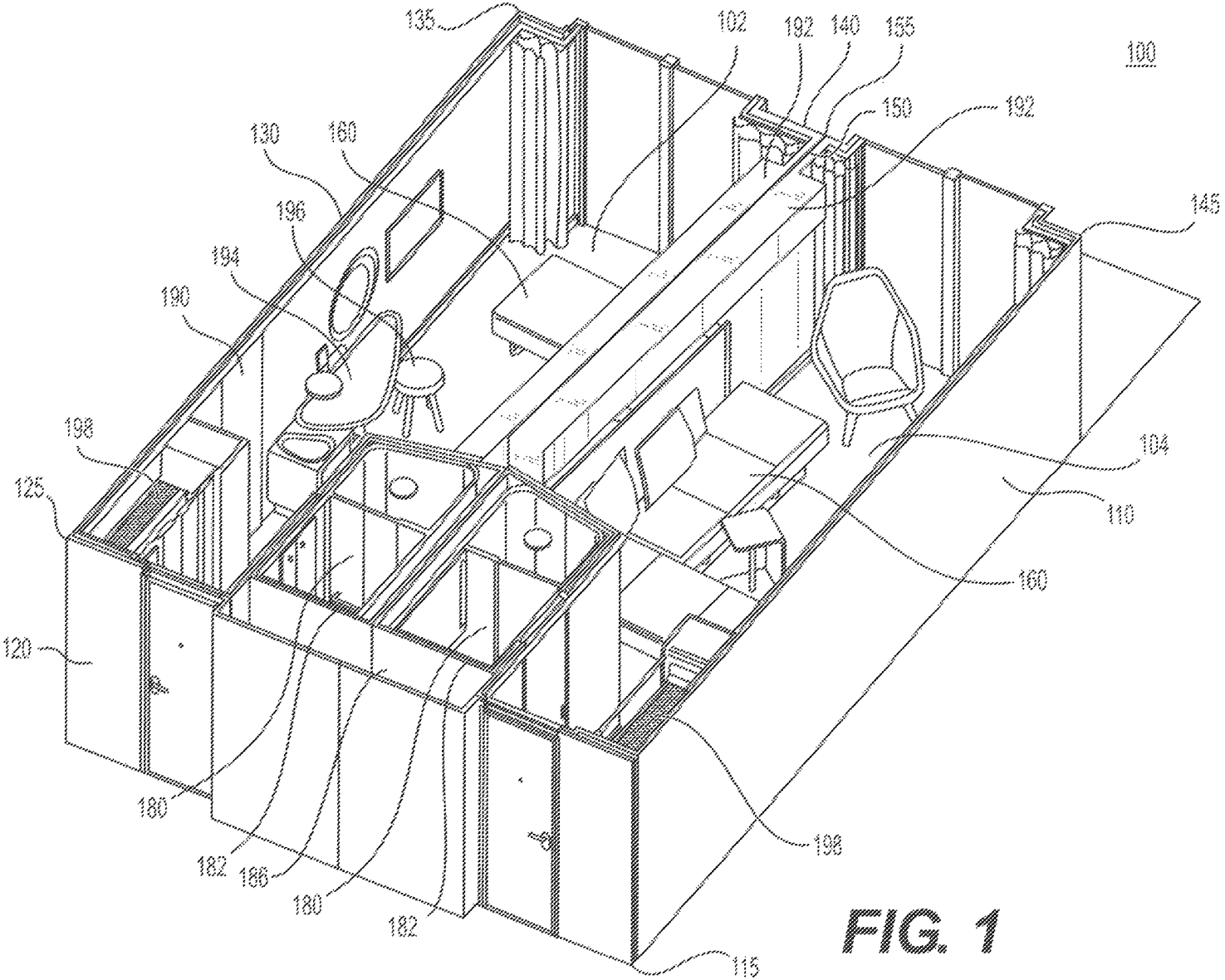
FIG. 1 is a perspective view of a double cabin featuring an angular wall according to an embodiment.

FIG. 1 shows a pair of cabins 100 comprising: a first cabin 102; a second cabin 104; wherein the first cabin 102 and the second cabin 104 are adjacent to each other and are defined by a first outer wall 110, a second outer wall 120, a third outer wall 130 and a fourth outer wall 140; the first outer wall 110, second outer wall 120, third outer wall 130 and fourth outer wall 140 defining a substantially rectangular area containing the first cabin 102 and the second cabin 104; wherein the first outer wall 110 meets the second outer wall 120 at a ninety (90) degree angle 115, the second outer wall 120 meets the third outer wall 130 at a ninety (90) degree angle 125, the third outer wall 130 meets the fourth outer wall 140 at a ninety (90) degree angle 135, and the fourth outer wall 140 meets the first outer wall 110 at a (90) degree angle 145; the first cabin 102 and second cabin 104 also sharing a common wall 150 separating the first cabin 102 from the second cabin 104; and wherein the common wall 150 separating the first cabin 102 from the second cabin 104 is operatively connected to an outer wall 110, 120, 130, or 140 at an angle other than ninety (90) degrees 155.

According to another aspect, the present embodiments may further comprise the method of creating a pair of cabins 100 wherein the first cabin 102, or the second cabin 104, or both the first cabin 102 and second cabin 104 further comprise at least one L shaped sofa bed 160 capable of being easily converted from a safe to a bed and back again and dimensioned large enough to accommodate two (2) users when configured as a bed.

Figure 4:
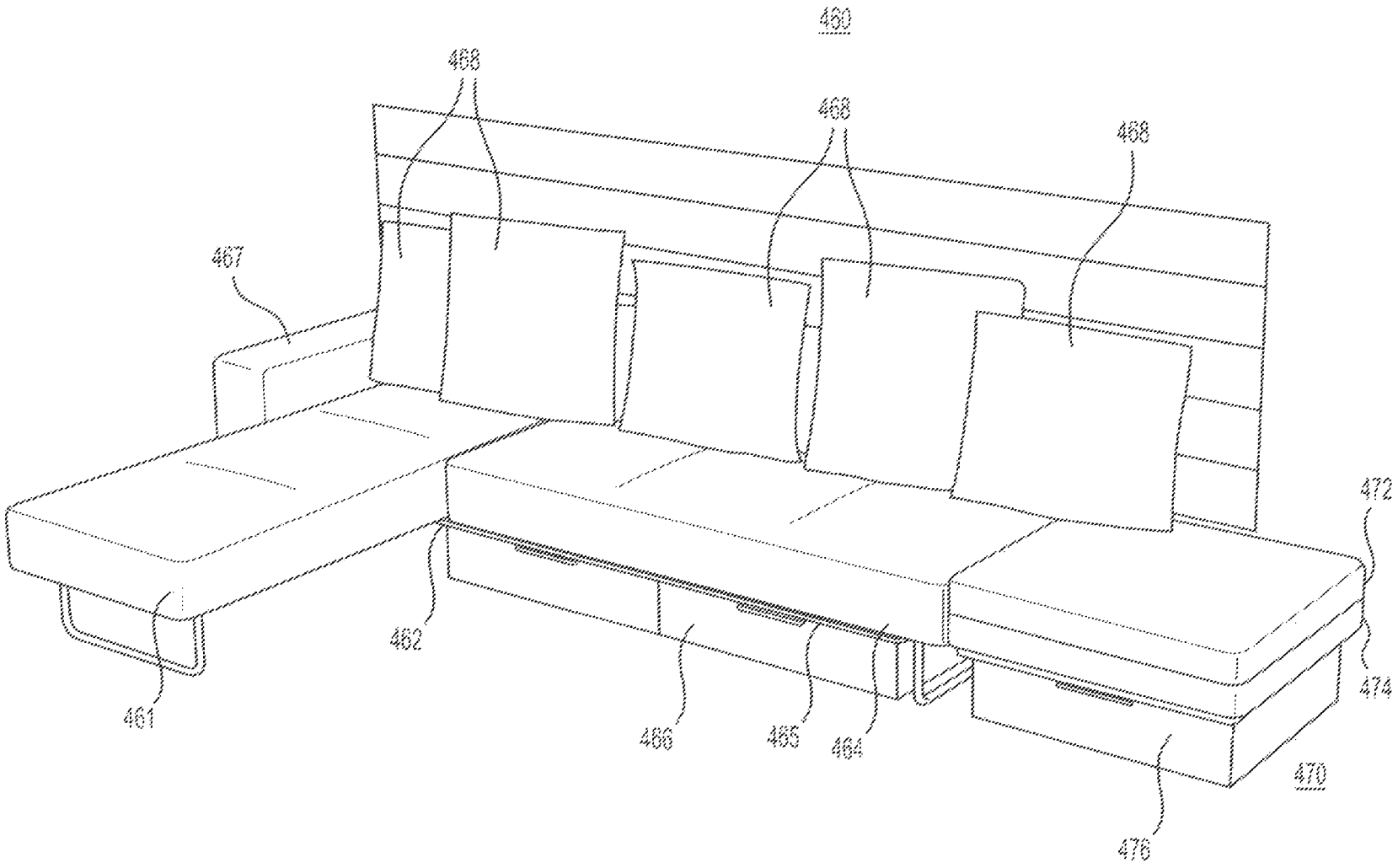
FIG. 4 is a perspective view of an L shaped sofa bed for a double cabin featuring an angular wall configured in sofa mode according to an embodiment.

Turning now to FIG. 4, FIG. 4 shows according to another aspect, the present embodiments may further comprise the method of creating a pair of cabins wherein the at least one L shaped sofa bed 460 further comprises a stationary mattress 461 on a plinth 462, a movable mattress 464 on a plinth 465 with drawers underneath 466, a movable armrest 467, and sofa back cushions 468 capable of being easily converted from a sofa to a bed and back again.

According to another aspect, the present embodiments may further comprise the method of creating a pair of cabins wherein the at least one L shaped sofa bed 460 is capable of being converted into a bed for two (2) users as well as capable of being converted into additional separate bed 470 for one (1) additional user.

According to another aspect, the present embodiments may further comprise the method of creating a pair of cabins wherein the at least one L shaped sofa bed 460 further comprises an additional mattress 472 on a plinth 474 with drawers underneath 476 capable of being convened into a bed by unfolding the additional mattress 472, or rotating the additional mattress 472 or both unfolding and rotating the additional mattress 472.

Turning now back to FIG. 1, FIG. 1 shows according to another aspect, the present embodiments may further comprise the method of creating a pair of cabins 100 wherein the at least one L shaped sofa bed 160 is positioned along the common wall 150.

According to another aspect, the present embodiments may further comprise the method of creating a pair of cabins 100, wherein the first cabin 102 and the second cabin 104 each further comprise a bathroom 180.

According to another aspect, the present embodiments may further comprise the method of creating a pair of cabins 100 wherein the bathroom 180 further comprises a firewall 182 between the bathroom 180 and a service space 186.

According to another aspect, the present embodiments may further comprise the method of creating a pair of cabins 100 wherein the first cabin 102, the second cabin 104, or both the first cabin 102 and second cabin 104 further comprise at least one interconnecting door 190 on at least one outer wall 110, 120, 130, or 140.

According to another aspect, the present embodiments may further comprise the method of treating a pair of cabins 100 wherein the first cabin 102, the second cabin 104, or both die first cabin 102 and second cabin 104 further comprise wherein heating, ventilation and air conditioning duct work 192 is positioned along the common wall 150.

According to another aspect, the present embodiments may further comprise the method of creating a pair of cabins 100 wherein the first cabin 102, the second cabin 104, or both the first cabin 102 and second cabin 104 further comprise a desk 194 and desk chair 196.

According to another aspect, the present embodiments may further comprise the method of creating a pair of cabins 100 wherein the first cabin 102, the second cabin 104, or both the first cabin 102 and second cabin 104 further comprise a closet 198.

Figure 2:
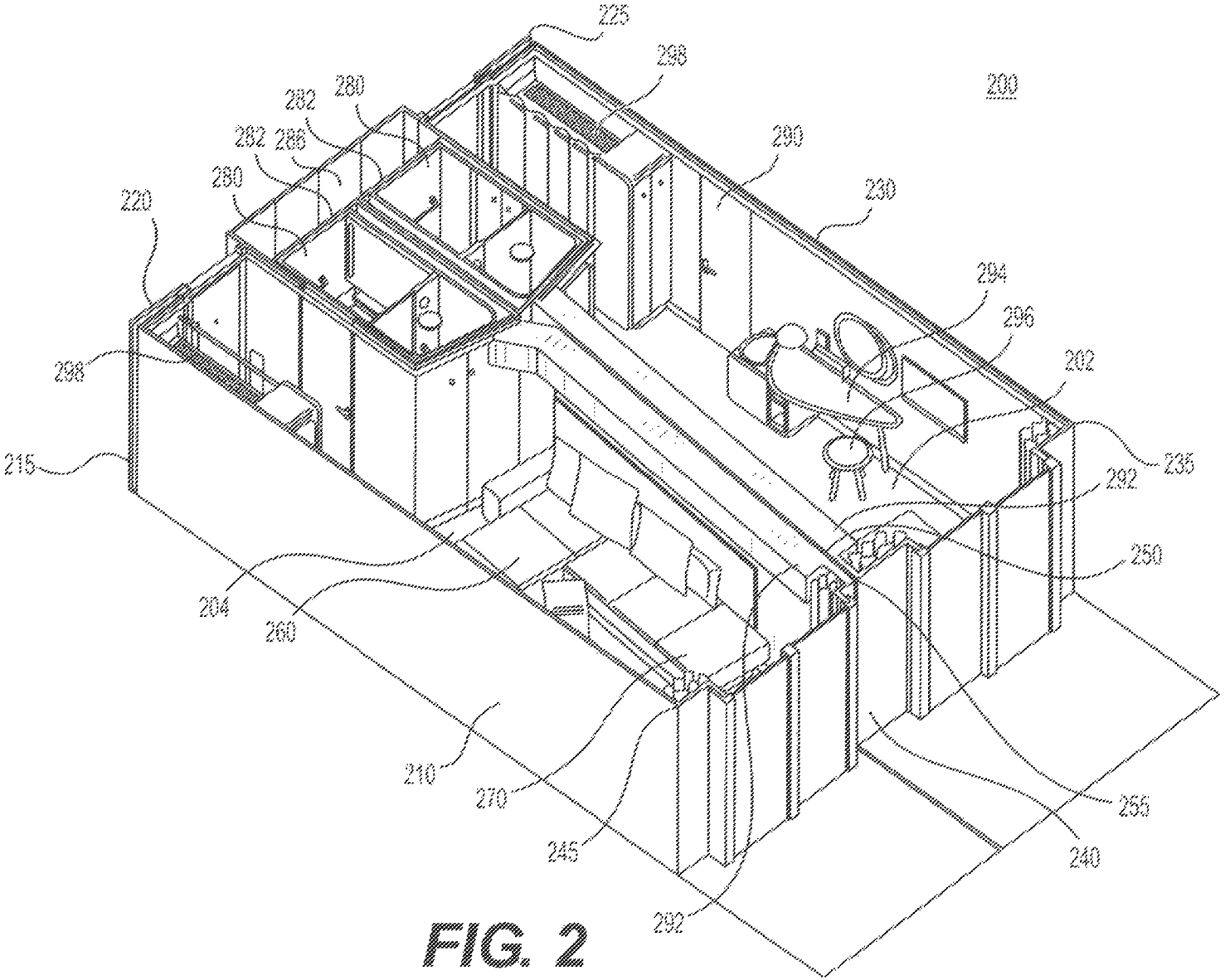
FIG. 2 is a perspective view of a double cabin featuring an angular wall according to another embodiment.
Figure 5:
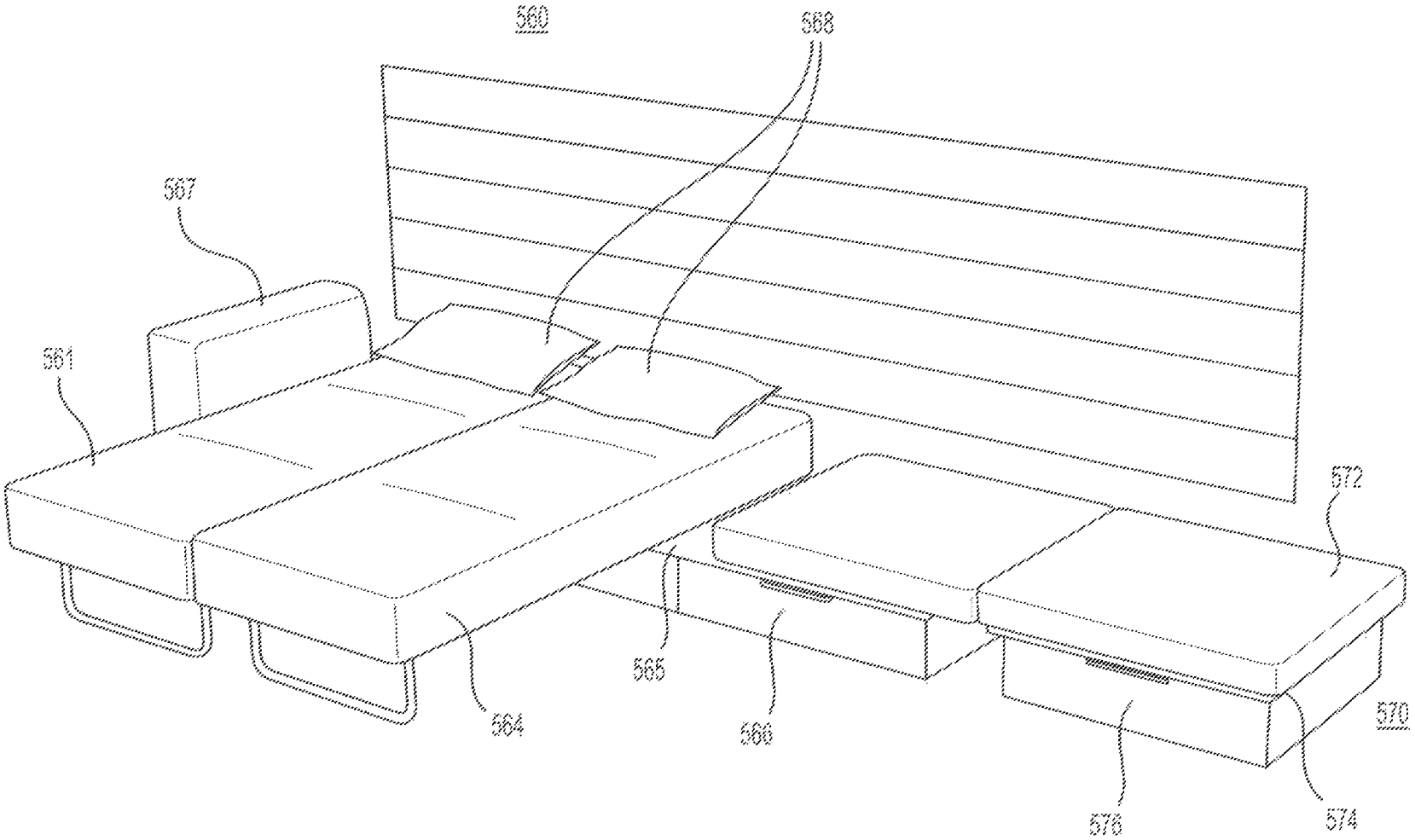
FIG. 5 is a perspective view of an L shaped sofa bed for a double cabin featuring an angular wall configured in bed mode according to an embodiment.

Turning now to FIG. 2 and FIG. 5, FIG. 2 and FIG. 5 shows according to another aspect, the present embodiments may be a method of creating a pair of cabins 200 comprising: a first cabin 202; a second cabin 204; wherein the first cabin 202 and the second cabin 204 are adjacent to each other and are defined by a first outer wall 210, a second outer wall 220, a third outer wall 230 and a fourth outer wall 240; the first outer wall 210, second outer wall 220, third outer wall 230 and fourth outer wall 240 defining a substantially rectangular area containing the first cabin 202 and the second cabin 204; wherein the first outer wall 210 meets the second outer 220 wall at a ninety (90) degree angle 215, the second outer 220 wall meets the third outer wall 230 at a ninety (90) degree angle 225, the third outer wall 230 meets the fourth outer wall 240 at a ninety (90) degree angle 235, and the fourth outer wall 240 meets the first outer wall 210 at a (90) degree angle 245; the first cabin and second cabin also sharing a common wall 250 separating the first cabin 202 from the second cabin 204; wherein the common wall 250 separating the first cabin 202 from the second cabin 204 is operatively connected to an outer wall 210, 220, 230 or 240 at an angle other than ninety (90) 255; wherein the first cabin 202, or the second cabin 204, or both the first cabin 202 and second cabin 204 further comprise at least one L shaped sofa bed 260 capable of being easily converted from a sofa to a bed and back again and dimensioned large enough to accommodate two (2) users when configured as a bed; and wherein the at least one L shaped sofa bed 260 further comprises a stationary mattress 561 on a plinth (not shown), a movable mattress 564 on a plinth 565 with drawers 566 underneath, a movable armrest 567, and sofa back cushions 568 capable of being easily convened from a sofa to a bed and back again.

Turning now to FIG. 5, FIG. 5 shows According to another aspect, the present embodiments may further comprise the method of creating a pair of cabins wherein the at least one L shaped sofa bed 560 is capable of being converted into a lied tor two (2) users as well as capable of being converted into additional separate bed 570 for one (1) additional user.

According to another aspect, the present embodiments may further comprise the method of creating a pair of cabins wherein the at least one L shaped sofa bed 560 further comprises an additional mattress 572 on a plinth 574 with drawers underneath 576 capable of being converted into a bed by unfolding the additional mattress 572, or rotating the additional mattress 572 or both unfolding and rotating the additional mattress 572.

Turning back to FIG. 2, FIG. 2 shows according to another aspect, the present embodiments may further comprise the method of creating a pair of cabins 200 wherein the at least one L shaped sofa bed 260 is positioned dong the common wall 250.

According to another aspect, the present embodiments may further comprise the method of creating a pair of cabins 200 wherein the first cabin 202 and the second cabin 204 each further comprise a bathroom 280.

According to another aspect, the present embodiments may further comprise live method of creating a pair of cabins 200 wherein the bathroom 280 further comprises a firewall 282 between the bathroom 280 and a service space 286.

According to another aspect, the present embodiments may further comprise the method of creating a pair of cabins 200 wherein the first cabin 202, the second cabin 204, or both the first cabin 202 and second cabin 204 further comprise at least one interconnecting door 290 on at least one outer wall 210, 220, 230, or 240.

In another aspect, the present embodiments may further comprise the method of creating a pair of cabins 200 wherein the first cabin 202, the second cabin 204, or both the first cabin 202 and second cabin 204 further comprise a desk 294, desk chair 296, and a closet 298 wherein heating, ventilation and air conditioning duet work 292 is positioned along the common wall 250.

Figure 3:
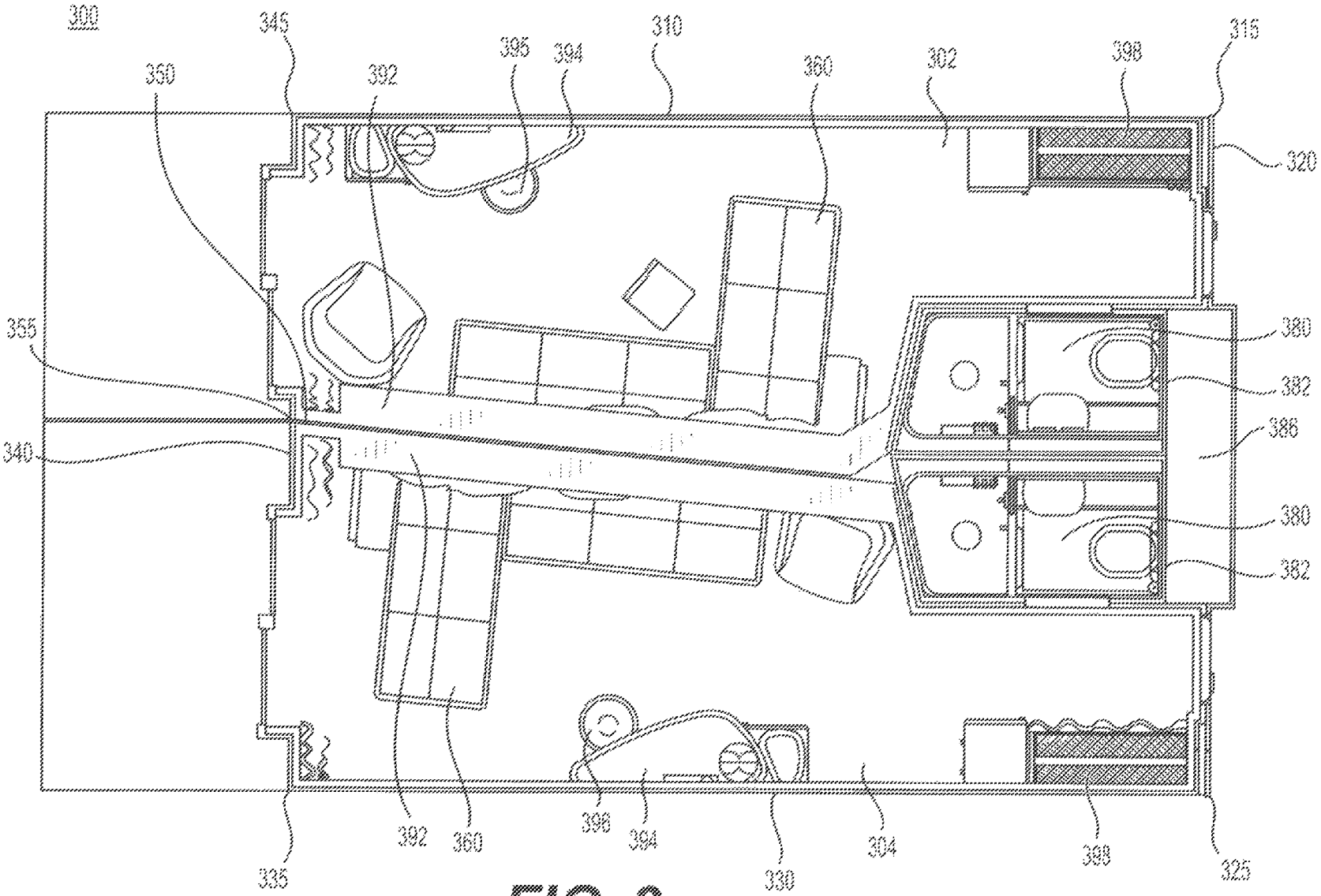
FIG. 3 is a top view of a double cabin featuring an angular wall according to another embodiment.

Turning now to FIG. 3 and FIG. 5, FIG. 3 and FIG. 5 shows according to another aspect, the present embodiments may be a method of creating a pair of cabins 300 comprising: a first cabin 302; a second cabin 304; wherein the first cabin 302 and the second cabin 304 are adjacent to each other and are defined by a first outer wall 310, a second outer wall 320, a third outer wall 330 and a fourth outer wall 340; the first outer wall 310, second outer wall 320, third outer wall 330 and fourth outer wall 340 defining a substantially rectangular area containing the first cabin 302 and the second cabin 304; wherein the first outer wall 310 meets the second outer wall 320 at a ninety (90) degree angle 315, the second outer wall 320 meets the third outer wall 330 at a ninety (90) degree angle 325, the third outer wall 330 meets the fourth outer wall 340 at a ninety (90) degree angle 315, and the fourth outer wall 340 meets the first outer wall 310 at a (90) degree angle 345; the first cabin 302 and second cabin 304 also sharing a common wall 350 separating the first cabin 302 from the second cabin 304; wherein the common wall 350 separating the first cabin 302 from the second cabin 304 is operatively connected to an outer wall 310, 320, 330 or 340 at an angle other titan ninety (90) degrees 355; wherein the first cabin 302, or the second cabin 304, or both the first cabin 302 and second cabin 304 further comprise at least one L shaped sofa bed 360 capable of being easily converted from a sofa to a bed and back again and dimensioned large enough to accommodate two (2) users when configured as a bed; and wherein the at least one L shaped sofa bed 360 further comprises a stationary mattress 561 on a plinth (not shown), a movable mattress 564 on a plinth 565 with drawers underneath 566, a movable armrest 567, and sofa back cushions 568 capable of being easily converted from a sofa to a bed and back again; wherein the at least one L shaped sofa bed 560 is positioned along the common wall 350; wherein the first cabin 302 and the second cabin 304 each further comprise a bathroom 380; wherein the bathroom further comprises a firewall 382 between the bathroom 384 and a service space 386; and wherein the first cabin 302, the second cabin 304, or both the first cabin 302 and second cabin 304 further comprise at least one interconnecting door (not shown) on at least one outer wall 310, 320, 330, or 340.

In another aspect, the present embodiments may further comprise the method of creating a pair of cabins 300 wherein the first cabin 302, the second cabin 304, or both the first cabin 302 and second cabin 304 further comprise a desk 304, desk chair 396, and a closet 398 wherein heating, ventilation and air conditioning duct work 392 is positioned along the common wall 350.

Figure 6:
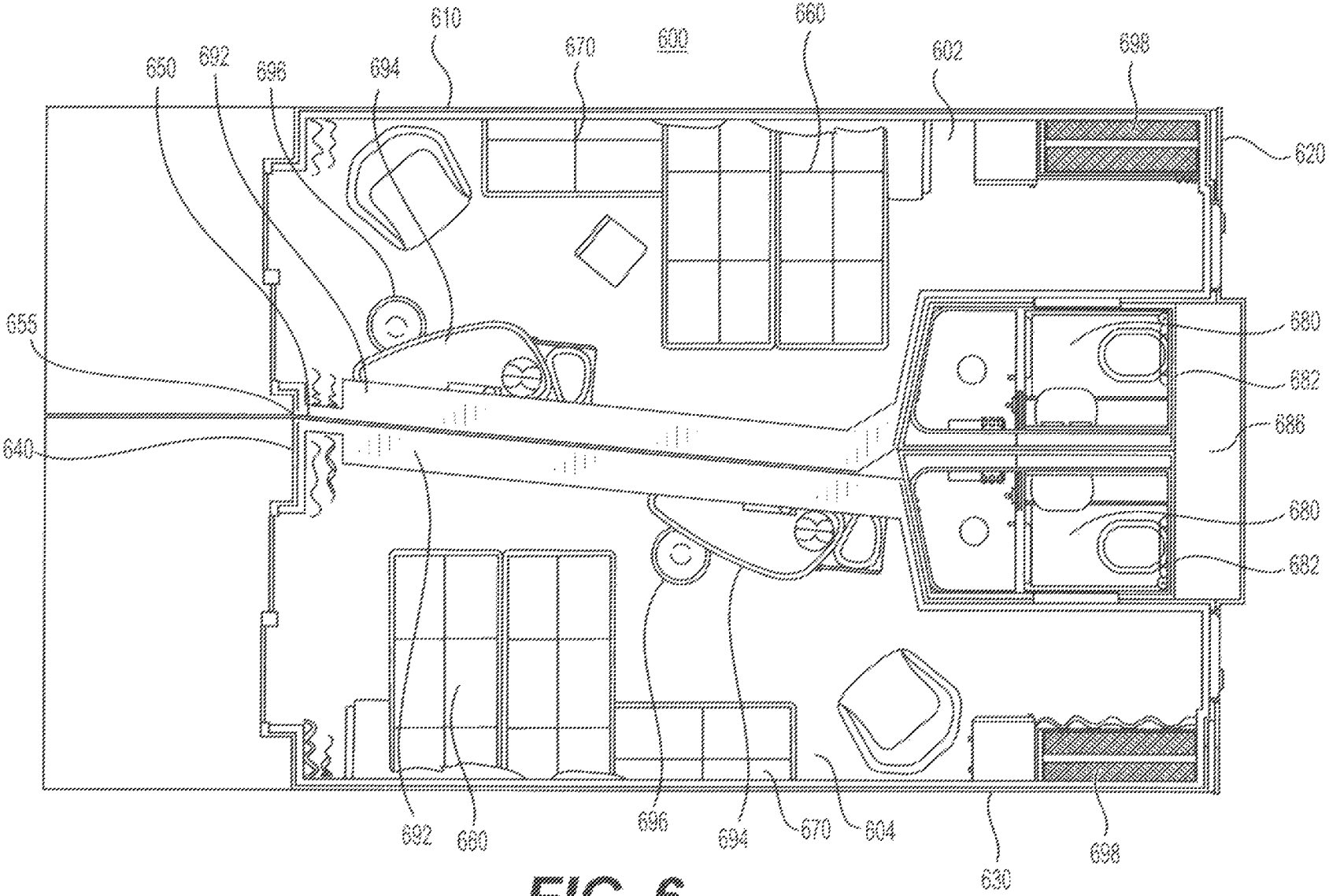
FIG. 6 is a top view of a double cabin featuring an angular wall according to another embodiment.

Turning now to FIG. 6 and FIG. 5, FIG. 6 and FIG. 5 shows according to another aspect, the present embodiments may be a method of creating a pair of cabins 600 comprising: a first cabin 602; a second cabin 604; wherein the first cabin 602 and the second cabin 604 are adjacent to each other and are defined by a first outer wall 610, a second outer wall 620, a third outer wall 630 and a fourth outer wall 640; the first outer wall 610, second outer wall 620, third outer wall 630 and fourth outer wall 640 defining a substantially rectangular area containing the first cabin 602 and the second cabin 604; wherein the first outer wall 610 meets the second outer wall 620 at a ninety (90) degree angle 615, the second outer wall 620 meets the third outer wall 630 at a ninety (90) degree angle 625, the third outer wall 630 meets the fourth outer wall 640 at a ninety (90) degree angle 635, and the fourth outer wall 640 meets the first outer wall 610 at a (90) degree angle 645; the first cabin 602 and second cabin 604 also sharing a common wall 650 separating the first cabin 602 from the second cabin 604; wherein the common wall 650 separating the first cabin 602 from the second cabin 604 is operatively connected to an outer wall 610, 620, 630 or 640 at an angle other than ninety (90) degrees 655; wherein the first cabin 602, or the second cabin 604, or both the first cabin 602 and second cabin 604 further comprise at least one L shaped sofa bed 660 capable of being easily converted from a sofa to a bed and back again and dimensioned large enough to accommodate two (2) users when configured as a bed; and wherein the at least one L shaped sofa bed 660 further comprises a stationary mattress 561 on a plinth (not shown), a movable mattress 564 on a plinth 565 with drawers underneath 566, a movable armrest 567, and sofa back cushions 568 capable of being easily converted from a sofa to a bed and back again; wherein the at least one L shaped sofa bed 560 is positioned along the common wall 650; wherein the first cabin 602 and the second cabin 604 each further comprise a bathroom 680; wherein the bathroom further comprises a firewall 682 between the bathroom 684 and a service space 686; and wherein the first cabin 602, the second cabin 604, or both the first cabin 602 and second cabin 604 further comprise at least one interconnecting door (not shown) on at least one outer wall 610, 620, 630, or 640.

In another aspect, the present embodiments may further comprise the method of creating a pair of cabins 600 wherein the first cabin 602, the second cabin 604, or both the first cabin 602 and second cabin 604 further comprise a desk 664, desk chair 696, and a closet 698 wherein heating, ventilation and air conditioning duct work 692 is positioned along the common wall 650.

The components of the apparatus illustrated are not limited to the specific embodiments described herein, but rather, features illustrated or described as part of one embodiment can be used on or in conjunction with other embodiments to yield yet a further embodiment. It is intended that the apparatus include such modifications and variations. Further, steps described in the method may be utilized independently and separately from other steps described herein.

While the apparatus and method have been described with reference to specific embodiments, it will be understood by those skilled in the art that various changes may be made and equivalents may be substituted for elements thereof without departing from the scope contemplated. In addition, many modifications may be made to adapt a particular situation or material to the teachings found herein without departing from the essential scope thereof.

In this specification and the claims that follow, reference will be made to a number of terms that have the following meanings. The singular forms "a," "an" and "the" include plural referents unless the context clearly dictates otherwise. Furthermore, references to "one embodiment", "some embodiments", "an embodiment" and the like are not intended to be interpreted as excluding the existence of additional embodiments that also incorporate the recited features. Approximating language, as used herein throughout the specification and claims, may be applied to modify any quantitative representation that could permissibly vary without resulting in a change in the basic function to which it is related. Accordingly, a value modified by a term such as "about" is not to be limited to the precise value specified. In some instances, the approximating language may correspond to the precision of an instrument for measuring the value. Terms such as "first," "second," "upper," "lower" etc. are used to identify one element from another, and unless otherwise specified are not meant to refer to a particular order or number of elements.

As used herein, the terms "may" and "may be" indicate u possibility of an occurrence within a set of circumstances; a possession of a specified property, characteristic or function; and/or quality another verb by expressing one or more of an ability, capability, or possibility associated with the qualified verb. Accordingly, usage of "may" and "may be" indicates that a modified term is apparently appropriate, capable, or suitable for an indicated capacity, function, or usage, while taking into account that in some circumstances the modified term may sometimes not be appropriate, capable, or suitable. For example, in some circumstances an event or capacity can be expected, while in other circumstances the event or capacity cannot occur—this distinction is captured by the terms "may" and "may be."

As used in the claims, the word "comprises" and its grammatical variants logically also subtend and include phrases of varying and differing extent such as for example, but not limited thereto, "consisting essentially of" and "consisting of." Where necessary, ranges have been supplied, and those ranges are inclusive of all sub-ranges therebetween. It is to be expected that variations in these ranges will suggest themselves to a practitioner having ordinary skill in the art and, where not already dedicated to the public, the appended claims should cover those variations.

Advances in science and technology may make equivalents and substitutions possible that are not now contemplated by reason of the imprecision of language; these variations should be covered by the appended claims. This written description uses examples to disclose the method, machine and computer-readable medium, including the best mode, and also to enable any person of ordinary skill in the art to practice these, including making and using any devices or systems and performing any incorporated methods. The patentable scope thereof is defined by the claims, and may include other examples that occur to those of ordinary skill in the art. Such other examples are intended to be within the scope of the claims if they have structural elements that do not differ from the literal language of the claims, or if they include equivalent structural elements with insubstantial differences from the literal language of the claims.

What is claimed is:

1. A pair of cabins comprising:

a first cabin;

a second cabin;

wherein the first cabin and the second cabin are adjacent to each other and are defined by a first outer wall, a second outer wall, a third outer wall and a fourth outer wall;

the first outer wall, second outer wall, third outer wall and fourth outer wall defining a substantially rectangular area containing the first cabin and the second cabin;

wherein the first outer wall meets the second outer wall at a ninety (90) degree angle, the second outer wall meets the third outer wall at a ninety (90) degree angle, the third outer wall meets the fourth outer wall at a ninety (90) degree angle, and the fourth outer wall meets the first outer wall at a (90) degree angle;

the first cabin and second cabin also sharing a common wall separating the first cabin from the second cabin; and wherein the common wall separating the first cabin from the second cabin is operatively connected to the first outer wall, the second outer wall, the third outer wall or the fourth outer wall at an angle other than ninety (90) degrees.

2. The pair of cabins of claim 1, wherein the first cabin, or the second cabin, or both the first cabin and second cabin further comprise at least one L shaped sofa bed capable of being easily converted from a sofa to a bed and back again and dimensioned large enough to accommodate two (2) users when configured as a bed.

3. The pair of cabins of claim 2, wherein the at least one L shaped sofa bed further comprises a stationary mattress on a plinth, a movable mattress on a plinth with drawers underneath, a movable armrest, and sofa back cushions capable of being easily converted from a sofa to a bed and back again.

4. The pair of cabins of claim 3, wherein the at least one L shaped sofa bed is capable of being converted into a bed for two (2) users as well as capable of being converted into additional separate bed for one (1) additional user.

5. The pair of cabins of claim 4, wherein the at least one L shaped sofa bed further comprises an additional mattress on a plinth with drawers underneath capable of being converted into a bed by unfolding the additional mattress, or rotating the additional mattress or both unfolding and rotating the additional mattress.

6. The pair of cabins of claim 2, wherein the at least one L shaped sofa bed is positioned along the common wall.

7. The pair of cabins of claim 1, wherein the first cabin and the second cabin each further comprise a bathroom.

8. The pair of cabins of claim 7, wherein the bathroom further comprises a firewall between the bathroom and a service space.

9. The pair of cabins of claim 1, wherein the first cabin, the second cabin, or both the first cabin and second cabin further comprise at least one interconnecting door on at least one of the first outer wall, the second outer wall, the third outer wall and the fourth outer wall.

10. The pair of cabins of claim 1, wherein the first cabin, the second cabin, or both the first cabin and second cabin further comprise heating, ventilation and air conditioning duct work is positioned along the common wall.

11. The pair of cabins of claim 1, wherein the first cabin, the second cabin, or both the first cabin and second cabin further comprise a desk and desk chair.

12. The pair of cabins of claim 1, wherein the first cabin, the second cabin, or both the first cabin and second cabin further comprise a closet.

13. A pair of cabins comprising:

a first cabin;

a second cabin;

wherein the first cabin and the second cabin are adjacent to each other and are defined by a first outer wall, a second outer wall, a third outer wall and a fourth outer wall;

the first outer wall, second outer wall, third outer wall and fourth outer wall defining a substantially rectangular area containing the first cabin and the second cabin;

wherein the first outer wall meets the second outer wall at a ninety (90) degree angle, the second outer wall meets the third outer wall at a ninety (90) degree angle, the third outer wall meets the fourth outer wall at a ninety (90) degree angle, and the fourth outer wall meets the first outer wall at a (90) degree angle;

the first cabin and second cabin also sharing a common wall separating the first cabin from the second cabin;

wherein the common wall separating the first cabin from the second cabin is operatively connected to the first outer wall, the second outer wall, the third outer wall or the fourth outer wall at an angle other than ninety (90) degrees;

wherein the first cabin, or the second cabin, or both the first cabin and second cabin further comprise at least one L shaped sofa bed capable of being easily converted from a sofa to a bed and back again and dimensioned large enough to accommodate two (2) users when configured as a bed; and wherein the at least one L shaped sofa bed further comprises a stationary mattress on a plinth, a movable mattress on a plinth with drawers underneath, a movable armrest, and sofa back cushions capable of being easily converted from a sofa to a bed and back again.

14. The pair of cabins of claim 13, wherein the at least one L shaped sofa bed is capable of being converted into a bed for two (2) users as well as capable of being converted into additional separate bed for one (1) additional user.

15. The pair of cabins of claim 14, wherein the at least one L shaped sofa bed further comprises an additional mattress on a plinth with drawers underneath capable of being converted into a bed by unfolding the additional mattress, or rotating the additional mattress or both unfolding and rotating the additional mattress.

16. The pair of cabins of claim 13, wherein the at least one L shaped sofa bed is positioned along the common wall.

17. The pair of cabins of claim 13, wherein the first cabin and the second cabin each further comprise a bathroom.

18. The pair of cabins of claim 17, wherein the bathroom further comprises a firewall between the bathroom and a service space.

19. The pair of cabins of claim 13, wherein the first cabin, the second cabin, or both the first cabin and second cabin further comprise at least one interconnecting door on at least one of the first outer wall, the second outer wall, the third outer wall and the fourth outer wall.

20. A pair of cabins comprising:

a first cabin;

a second cabin;

wherein the first cabin and the second cabin are adjacent to each other and are defined by a first outer wall, a second outer wall, a third outer wall and a fourth outer wall;

the first outer wall, second outer wall, third outer wall and fourth outer wall defining a substantially rectangular area containing the first cabin and the second cabin;

wherein the first outer wall meets the second outer wall at a ninety (90) degree angle, the second outer wall meets the third outer wall at a ninety (90) degree angle, the third outer wall meets the fourth outer wall at a ninety (90) degree angle, and the fourth outer wall meets the first outer wall at a (90) degree angle;

the first cabin and second cabin also sharing a common wall separating the first cabin from the second cabin;

wherein the common wall separating the first cabin from the second cabin is operatively connected to the first outer wall, the second outer wall, the third outer wall or the fourth outer wall at an angle other than ninety (90) degrees;

wherein the first cabin, or the second cabin, or both the first cabin and second cabin further comprise at least one L shaped sofa bed capable of being easily converted from a sofa to a bed and back again and dimensioned large enough to accommodate two (2) users when configured as a bed; and wherein the at least one L shaped sofa bed further comprises a stationary mattress on a plinth, a movable mattress on a plinth with drawers underneath, a movable armrest, and sofa back cushions capable of being easily converted from a sofa to a bed and back again;

wherein the at least one L shaped sofa bed is positioned along the common wall;

wherein the first cabin and the second cabin each further comprise a bathroom;

wherein the bathroom further comprises a firewall between the bathroom and a service space; and wherein the first cabin, the second cabin, or both the first cabin and second cabin further comprise at least one interconnecting door on at least one of the first outer wall, the second outer wall, the third outer wall and the fourth outer wall.

* * * * *